US008408337B2

(12) United States Patent
Livingstone

(10) Patent No.: US 8,408,337 B2
(45) **Date of Patent: *Apr. 2, 2013**

(54) DOWNHOLE BLOWOUT PREVENTOR

(75) Inventor: James I. Livingstone, Calgary (CA)

(73) Assignee: Presssol Ltd., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/188,670

(22) Filed: Aug. 8, 2008

(65) Prior Publication Data

US 2008/0289878 A1 Nov. 27, 2008

Related U.S. Application Data

(63) Continuation of application No. 10/906,277, filed on Feb. 11, 2005, now abandoned.

(60) Provisional application No. 60/521,056, filed on Feb. 12, 2004.

(51) Int. Cl.
*E21B 21/10* (2006.01)

(52) U.S. Cl. ..... 175/232; 175/231; 175/235; 175/318

(58) Field of Classification Search ..... 175/231, 175/232, 235, 318

See application file for complete search history.

(56) References Cited

U.S. PATENT DOCUMENTS

| | | | |
|---|---|---|---|
| 2,609,836 | A | 9/1952 | Knox |
| 3,075,589 | A | 1/1963 | Grable et al. |
| 3,416,618 | A | 12/1968 | Kunnemann |
| 3,770,006 | A | 11/1973 | Sexton et al. |
| 3,792,429 | A | 2/1974 | Patton et al. |
| 3,795,283 | A | 3/1974 | Oughton |
| 3,920,090 | A | 11/1975 | McQueen et al. |
| 4,055,224 | A | 10/1977 | Wallers |
| 4,076,077 | A | 2/1978 | Nix et al. |
| 4,100,528 | A | 7/1978 | Bernard et al. |
| 4,219,087 | A | 8/1980 | Johnson |
| 4,220,176 | A | 9/1980 | Russell |
| 4,243,252 | A | 1/1981 | Johnson |

(Continued)

FOREIGN PATENT DOCUMENTS

| | | |
|---|---|---|
| CA | 1325969 | 10/1987 |
| CA | 2424608 | 6/2004 |

(Continued)

OTHER PUBLICATIONS

Underbalanced Drilling; Nowsco.

(Continued)

*Primary Examiner* — Nicole Coy
(74) *Attorney, Agent, or Firm* — Bennett Jones LLP

(57) ABSTRACT

The downhole flow control means or downhole blowout preventor (downhole BOP) of the present invention is adapted for use during reverse circulation drilling with both concentric drill pipe and concentric coiled tubing. The downhole BOP comprises an inner tube member having an inner passage therethrough and an outer casing forming an annular passage between the inner tube member and the outer casing. The inner passage and the annular passage of the downhole BOP is in fluid communication with the inner passage and annular passage, respectively, of the concentric drill pipe or concentric coiled tubing. The downhole BOP further comprises two valve means, preferably a check valve and a ball valve, for closing off the annular passage and the inner passage of the downhole BOP, respectively. In a preferred embodiment, the downhole BOP further comprises an electric actuator for opening and closing the ball valve.

13 Claims, 4 Drawing Sheets

U.S. PATENT DOCUMENTS

| | | | |
|---|---|---|---|
| 4,254,836 | A | 3/1981 | Russell |
| 4,321,974 | A | 3/1982 | Klemm |
| 4,391,328 | A | 7/1983 | Aumann |
| 4,431,069 | A | 2/1984 | Dickinson, III et al. |
| 4,461,448 | A | 7/1984 | Huey et al. |
| 4,463,814 | A | 8/1984 | Horstmeyer et al. |
| 4,509,606 | A | 4/1985 | Willis |
| 4,534,426 | A | 8/1985 | Hooper |
| 4,647,002 | A | 3/1987 | Crutchfield |
| 4,671,359 | A | 6/1987 | Renfro |
| 4,681,164 | A | 7/1987 | Stacks |
| 4,705,119 | A | 11/1987 | Kostylev et al. |
| 4,709,768 | A | 12/1987 | Kostylev et al. |
| 4,718,503 | A | 1/1988 | Stewart |
| 4,739,844 | A | 4/1988 | Farris et al. |
| 4,744,420 | A | 5/1988 | Patterson et al. |
| 4,790,391 | A | 12/1988 | Hamamura et al. |
| 4,832,126 | A | 5/1989 | Roche |
| 5,006,046 | A | 4/1991 | Buckman et al. |
| 5,020,611 | A | 6/1991 | Morgan et al. |
| 5,033,545 | A | 7/1991 | Sudol |
| 5,068,842 | A | 11/1991 | Naito |
| 5,174,394 | A | 12/1992 | Fischer et al. |
| 5,178,223 | A | 1/1993 | Smet |
| 5,199,515 | A | 4/1993 | Sinclair et al. |
| 5,236,036 | A | 8/1993 | Ungemach et al. |
| 5,285,204 | A | 2/1994 | Sas-Jaworsky |
| 5,348,097 | A | 9/1994 | Giannesini et al. |
| 5,396,966 | A | 3/1995 | Roos, Jr. et al. |
| 5,411,105 | A | 5/1995 | Gray |
| 5,435,395 | A | 7/1995 | Connell |
| 5,513,528 | A | 5/1996 | Holenka et al. |
| 5,575,451 | A | 11/1996 | Colvin et al. |
| 5,638,904 | A | 6/1997 | Misselbrook et al. |
| 5,720,356 | A | 2/1998 | Gardes |
| 5,881,813 | A | 3/1999 | Brannon et al. |
| 5,890,540 | A | 4/1999 | Pia et al. |
| 5,892,460 | A | 4/1999 | Jerabek et al. |
| 6,015,015 | A | 1/2000 | Luft et al. |
| 6,047,784 | A | 4/2000 | Dorel |
| 6,065,550 | A | 5/2000 | Gardes |
| 6,109,370 | A | 8/2000 | Gray |
| 6,158,531 | A | 12/2000 | Vail, III |
| 6,189,617 | B1 | 2/2001 | Sorhus et al. |
| 6,192,985 | B1 | 2/2001 | Hinkel et al. |
| 6,196,336 | B1 | 3/2001 | Fincher et al. |
| 6,209,663 | B1 | 4/2001 | Hosie |
| 6,209,665 | B1 | 4/2001 | Holte |
| 6,213,201 | B1 | 4/2001 | Renkis |
| 6,250,383 | B1 | 6/2001 | Patel |
| 6,263,987 | B1 | 7/2001 | Vail, III |
| 6,325,159 | B1 | 12/2001 | Peterman et al. |
| 6,359,438 | B1 | 3/2002 | Bittar |
| 6,377,050 | B1 | 4/2002 | Chemali et al. |
| 6,394,197 | B1 | 5/2002 | Holte |
| 6,405,809 | B2 | 6/2002 | Patel et al. |
| 6,457,540 | B2 | 10/2002 | Gardes |
| 6,481,501 | B2 | 11/2002 | Chavez et al. |
| 6,497,290 | B1 | 12/2002 | Misselbrook et al. |
| 6,668,933 | B2 | 12/2003 | Kent |
| 6,745,855 | B2 | 6/2004 | Gardes |
| 6,892,829 | B2 | 5/2005 | Livingstone |
| 6,918,452 | B2 | 7/2005 | Chan et al. |
| 7,090,033 | B2 | 8/2006 | Chan et al. |
| 2002/0000332 | A1 | 1/2002 | Merecka et al. |
| 2003/0141111 | A1 | 7/2003 | Pia |
| 2003/0150621 | A1 | 8/2003 | Pia |
| 2003/0155156 | A1 | 8/2003 | Livingstone |

FOREIGN PATENT DOCUMENTS

| | | |
|---|---|---|
| CA | 2483174 | 4/2005 |
| CA | 2483244 | 4/2005 |
| EP | 0787886 | 5/1997 |
| EP | 1 245 783 | 2/2002 |
| FR | 2597150 | 4/1986 |
| GB | 2368079 | 10/2000 |
| WO | WO 97/05361 | 2/1997 |
| WO | WO 97/35093 | 9/1997 |
| WO | WO 00/57019 | 9/2000 |
| WO | WO 01/90528 | 11/2001 |
| WO | WO 02/10549 | 2/2002 |

OTHER PUBLICATIONS

Nowsco/Downhole Systems: "Test, Treat, Test System Using a Concentric Coiled Tubing/DST Package": Hoyer, Fried & Sask.

BlackMax Downhole Tools; An NQL Drilling Tools Inc. Company; Electro Magnetic Measurement While Drilling; Oil & Gas Application; EM=MWD.

Logging While Drilling; http://www.odp.tamu.edu/publications/196_IR/chap_2/c2_.htm.

Drilling and Formation Evaluation; Baker Hughes; www.bakerhughes.com/bakerhughes/products/well.htm.

On Trak MWD System; Baker Hughes; www.bakerhughes.com/inteq/evaluation/ontrak/index.htm.

PressTEQ Application Examples; Baker Hughes; www.bakerhughes.com/inteq/D&P/pressure/index.htm.

Thruster Drilling System; Baker Hughes; www.bakerhughes.com/inteq/Drilling/thruster/index.htm.

Coiled Tubing; Baker Hughes; Baker Oil Tools Coiled Tubing Solutions; www.bakerhughes.com/bot/coiled_tubing/index/htm.

COLT Coil Tubing Drilling Bottom Hole Assembly; Antech Special Engineering Products; Coiled Tubing Downhole Tools.

U.S. Appl. No. 10/644,749, filed Aug. 21, 2003 by James Livingstone.

DOWNHOLE BLOWOUT PREVENTOR

This application is a Continuation of U.S. patent application Ser. No. 10/906,277, filed Feb. 11, 2005, which claims the benefit of U.S. Provisional Application No. 60/521,056, filed Feb. 12, 2004.

FIELD OF USE

The present invention relates to an apparatus that allows concentric drill string to be safely used in reverse circulation drilling of a wellbore in hydrocarbon formations. In particular, the present invention relates to a downhole blowout preventor adapted for use with concentric drill pipe or concentric coiled tubing. The downhole blowout preventor of the present invention can also be used when testing isolated zones for flow of hydrocarbons. In addition, the apparatus of the present invention can be used in coal mining or other mineral extraction operations where concentric drill pipe or concentric coiled tubing is being used to mine coal or drill for minerals and various gases or fluids could present a hazardous situation.

BACKGROUND OF THE INVENTION

Conventional drilling typically uses single wall jointed drill pipe or single wall coiled tubing with a drill bit attached at one end. Weighted drilling mud or fluid is pumped through a rotating drill pipe to drive the drill bit to drill a borehole. The drill cuttings and exhausted drilling mud and fluid are returned to the surface up the annulus between the drill string and the formation by using mud, fluids, gases or various combinations of each to create enough pressure to transport the cuttings out of the wellbore. Compressed air can also be used to drive a rotary drill bit or air hammer. However, in order to transport the drill cuttings out of the wellbore, the hydrostatic head of the fluid column can often exceed the pressure of the formation being drilled. Therefore, the drilling mud or fluid can invade into the formation, causing significant damage to the formation, which ultimately results in loss of production. In addition, the drill cuttings themselves can cause damage to the formation as a result of the continued contact with the formation and the drill cuttings. Air drilling with a rotary drill bit or air hammer can also damage the formation by exceeding the formation pressure and by forcing the drill cuttings into the formation.

Underbalanced drilling technology has been developed to reduce the risk of formation damage due to the hydrostatic head of the fluid column, which uses a mud or fluid system that is not weighted. Hence, drill cutting can be removed without having the fluid column hydrostatic head exceed the formation being drilled resulting in less damage to the formation. Underbalanced drilling techniques typically use a commingled stream of liquid and gas such as nitrogen or carbon dioxide as the drilling fluid.

Nevertheless, even when using underbalanced drilling technology, there still is the possibility of damage to the formation. The drilling fluid and drill cuttings are still being returned to the surface via the annulus between the drill pipe and the formation. Hence, some damage to the formation may still occur due to the continued contact of the drilling cuttings and fluid with the formation. As well, underbalanced drilling is very expensive for wells with low or moderate production rates.

Formation damage is becoming a serious problem for exploration and production of unconventional petroleum resources. For example, conventional natural gas resources are buoyancy driven deposits with much higher formation pressures. Unconventional natural gas formations such as gas in low permeability or "tight" reservoirs, coal bed methane, and shale gases are not buoyancy driven accumulations and thus have much lower pressures. Therefore, such formations would damage much easier when using conventional oil and gas drilling technology. There was a need for a drilling method that reduces the amount of formation damage that normally results when using air drilling, mud drilling, fluid drilling and underbalanced drilling.

Two such methods have recently been disclosed in U.S. Patent Applications Publication Nos. 20030173088 and 20030155156, incorporated herein by reference, using concentric drill pipe and concentric coiled tubing, respectively. The methods each comprise the steps of (a) providing a concentric drill string having an inner pipe or tube situated within an outer pipe or tube defining an annulus between the two pipes or tubes, (b) connecting a drilling means at the lower end of the concentric drill string, and (c) delivering drilling medium through one of the annulus or inner pipe or tube and removing the exhausted drilling medium and entrained drill cuttings by extracting the exhausted drilling medium through the other of the annulus or inner pipe or tube.

These methods for drilling a wellbore can further comprise the step of providing a downhole flow control means positioned near the drilling means for preventing any flow of hydrocarbons from the inner pipe or tube or the annulus or both to the surface when the need arises. When using concentric drill pipe, the flow control means will also operate to shut down the flow from both the inner pipe and the annulus when joints of concentric drill pipe are being added or removed.

A downhole flow control means can also be used when testing a well for flow of hydrocarbons and the like during the reverse circulation drilling process. During drilling, the downhole flow control means is in the complete open position to allow for the reverse circulation of the drilling fluid, i.e., drilling fluid can be pumped down either the annulus or inner space of the inner pipe or tube and exhausted drilling fluid and drill cuttings are removed through the other of said annulus or inner space. However, when testing is required during the reverse circulation drilling process, the wellbore annulus is sealed off and the downhole blowout preventor seals off either the annulus or the inner space. Thus, the material to be tested can flow to the surface through the other of the annulus or inner space.

There is a need for a downhole flow control means or a downhole blowout preventor for use with concentric drill string that is fast, easy and safe to use.

SUMMARY OF THE INVENTION

The downhole flow control means or downhole blowout preventor (downhole BOP) of the present invention is adapted for use with both concentric drill pipe and concentric coiled tubing. The downhole BOP comprises an inner tube, an outer casing and an annulus formed between the outer wall of the inner tube and the outer casing. The downhole BOP further comprises two valve means, preferably a check valve and a ball valve, for closing off the annular passage and the inner passage of the inner tube, respectively.

The downhole BOP is placed as close to the drilling means as possible. The drilling means, which is attached to the concentric drill pipe or concentric coiled tubing, could be a reciprocating air hammer and a drill bit, a positive displacement motor and a reverse circulating drill bit, a reverse circulating mud motor and a rotary drill bit, a drill bit connected to concentric drill pipe, an electric motor and drill bit or any combination thereof.

During drilling, drilling medium is delivered to the drilling means through one of the annulus or inner pipe or tube of the concentric drill pipe or concentric coiled tubing. The drilling medium can comprise a liquid drilling fluid such as, but not limited to, water, diesel or drilling mud, or a combination of liquid drilling fluid and gas such as, but not limited to, air, nitrogen, carbon dioxide, and methane, or gas alone.

Exhausted drilling medium comprising drilling medium, drilling cuttings and hydrocarbons are removed from the wellbore by extraction through the other of the annulus or inner pipe or tube of the concentric drill pipe or concentric coiled tubing.

The downhole BOP is adapted to fit between two pieces of concentric drill pipe or at or near the bottom of the concentric coiled tubing such that the annulus and inner tube of the downhole BOP and the annulus and inner pipe or tube of the concentric drill string essentially line up. Thus, the annular passage and the inner passage of the concentric drill string are in fluid communication with the annular passage and inner passage of the downhole BOP, respectively. Hence, when both valve means are in the closed position, drill medium, drill cuttings, formation fluids, or hydrocarbons are prevented from flowing in an uncontrolled manner to surface through the annulus or inner pipe or tube of either concentric drill pipe or concentric coiled tubing.

Use of a downhole BOP during reverse circulation drilling with concentric drill pipe provides one or more of the following advantages:

(1) there are no hydrocarbons escaping on the rig floor while concentric drill pipe is tripped in or out of the wellbore;

(2) when drilling with a liquid drilling medium, the annular passage and inner passage of the inner pipe of the concentric drill pipe can be closed each time a new joint of drill pipe is added to the drill string. This prevents the loss of drilling fluids into the formation containing hydrocarbons;

(3) upon entering an under pressured formation, the annular passage and inner passage of the inner pipe of the concentric drill pipe can be closed and the hydrostatic weight of the drilling fluid can be reduced below formation pressure by adding a gas such as nitrogen. The overbalanced drilling fluid is not lost into the formation while the gas is added to the drilling fluid;

(4) if kill fluid were required to control an over pressured situation in the well bore, it could be pumped down both the annulus and inner space of the inner pipe of the concentric drill pipe; and (5) the inner pipe of the concentric drill pipe could also be used to bleed down the wellbore pressure in an over pressure situation.

When reverse circulation drilling with concentric coiled tubing instead of concentric drill pipe, one or more of advantages (3) to (5) may also apply when using the downhole BOP of the present invention.

DETAILED DESCRIPTION OF THE PREFERRED EMBODIMENT

The present invention will be described with reference to the following preferred embodiment.

Figure 1:
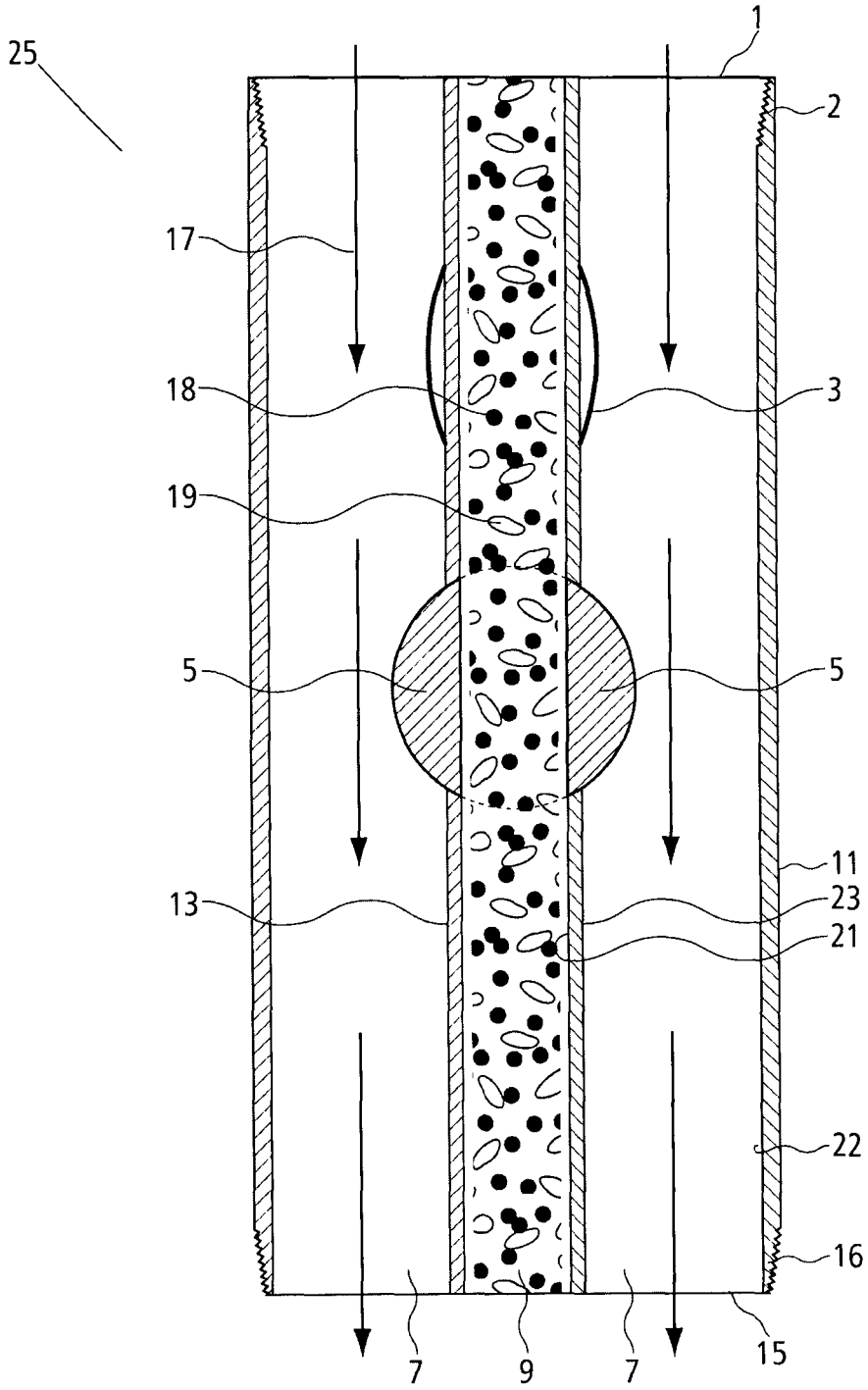
FIG. 1 is a vertical cross section of the downhole BOP of the present invention in the fully open position.

FIG. 1 is a vertical cross section of downhole BOP 25 in the fully open position. The top end 1 of the downhole BOP 25 can be connected directly to concentric drill pipe or concentric coiled tubing by means of the threaded box end connection 2. Depending on the drilling operation, the top end 1 of the downhole BOP 25 could also be connected to a Bottom Hole Assembly (BHA, not shown).

The bottom end 15 of the downhole BOP 25 can be connected directly to the rotary drill bit, air hammer or BHA by the threaded pin end connection 16.

The downhole BOP 25 comprises an inner steel pipe or steel tubing 23 and an outer casing 11. The inner steel pipe or steel tubing 23 forms an inner passage 9 therethrough by inner wall 21. Annular passage 7 is formed between the outer wall 13 of the inner steel pipe or steel tubing 23 and the inner wall 22 of the outer casing 11.

When the downhole BOP 25 is connected to the concentric drill string, the annular passage and inner passage of the concentric drill string is in fluid communication with the annular passage 7 and inner passage 9 of the downhole BOP 25, respectively.

The downhole BOP further comprises two valve means, check valve 3 and ball valve 5. Check valve 3 is a typical check valve known in the drilling art, which opens and closes depending on pressure. Check valve 3 is responsible for sealing off annular passage 7 of the downhole BOP 25. When no pressure is being applied down annular passage 7, the check valve 3 is in the closed position.

Ball valve 5 is a full opening ball valve commonly used in the drilling industry (see, for example, Ironbound ball valves, William E. Williams Valve Corporation ball valves and the ball valve assembly of U.S. Pat. No. 6,668,933, incorporated herein by reference). The advantage in using a full opening ball valve is that there is no restriction in the flow through the inner passage 9. Ball valve 5 can be manually activated by means of pressure exerted on the bottom of the concentric drill string and turning the concentric drill string to open or close the valve.

Figure 4:
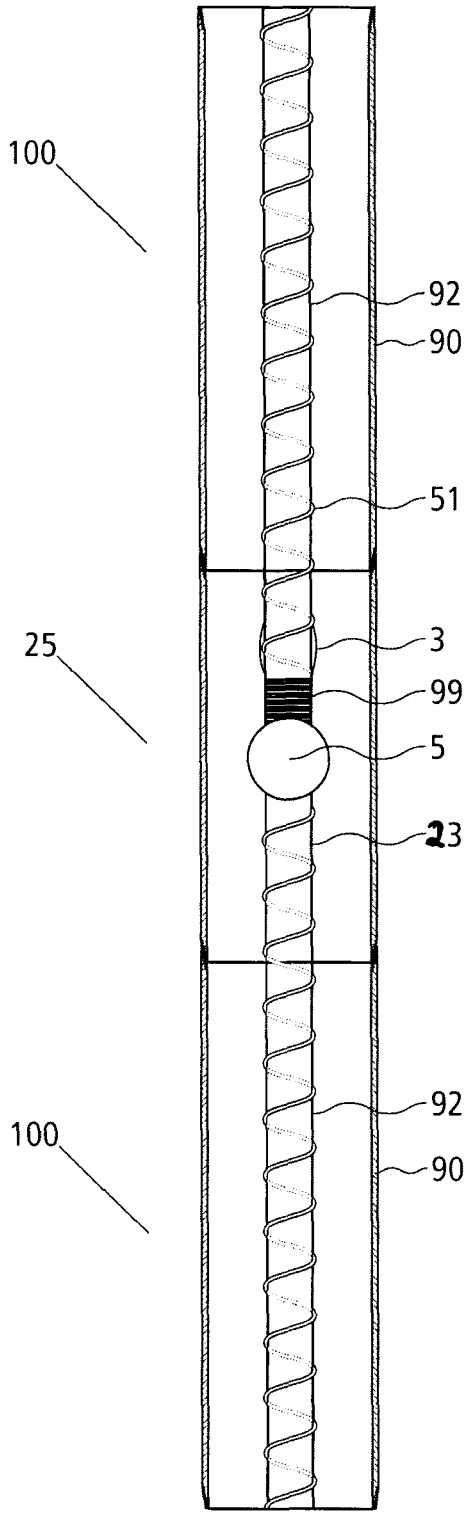
FIG. 4 is a vertical cross section of concentric drill string having a downhole BOP of the present invention attached thereto.

Preferably, downhole BOP 25 further comprises a pneumatic actuator, a hydraulic actuator or electric actuator (as shown in FIG. 4) for activating or operating ball valve 5. A pneumatic actuator uses air pressure to open and close the ball valve. A hydraulic activator uses hydraulic fluid pressure to open and close the ball valve. Finally, an electric actuator, which preferably comprises an electric motor and gear drive, operates electrically to rotate the ball within the valve. Typically, two electric circuits are required, one for opening and one for closing the valve.

In operation, when drilling medium 17 is pumped down the annular passage between the outer pipe or tube and inner passage of the inner pipe or tube of the attached concentric drill string (not shown), the drilling medium 17 also passes through annular passage 7 of the downhole BOP. The pressure of the drilling fluid 17 opens check valve 3 and allows drilling medium 17 to flow through the annular passage 7 of the downhole BOP 25 without any restriction or change in the inside diameter flow paths of the concentric drill string, i.e., the concentric drill pipe or concentric coiled tubing.

When ball valve 5 is in the open position, it allows exhausted or spent drilling medium, drill cuttings, formation fluids and/or hydrocarbons (collectively referred to as reference 19) to flow through inner passage 9 without any restrictions or change in the inside diameter flow paths of the concentric drill string or concentric coiled tubing.

Figure 2:
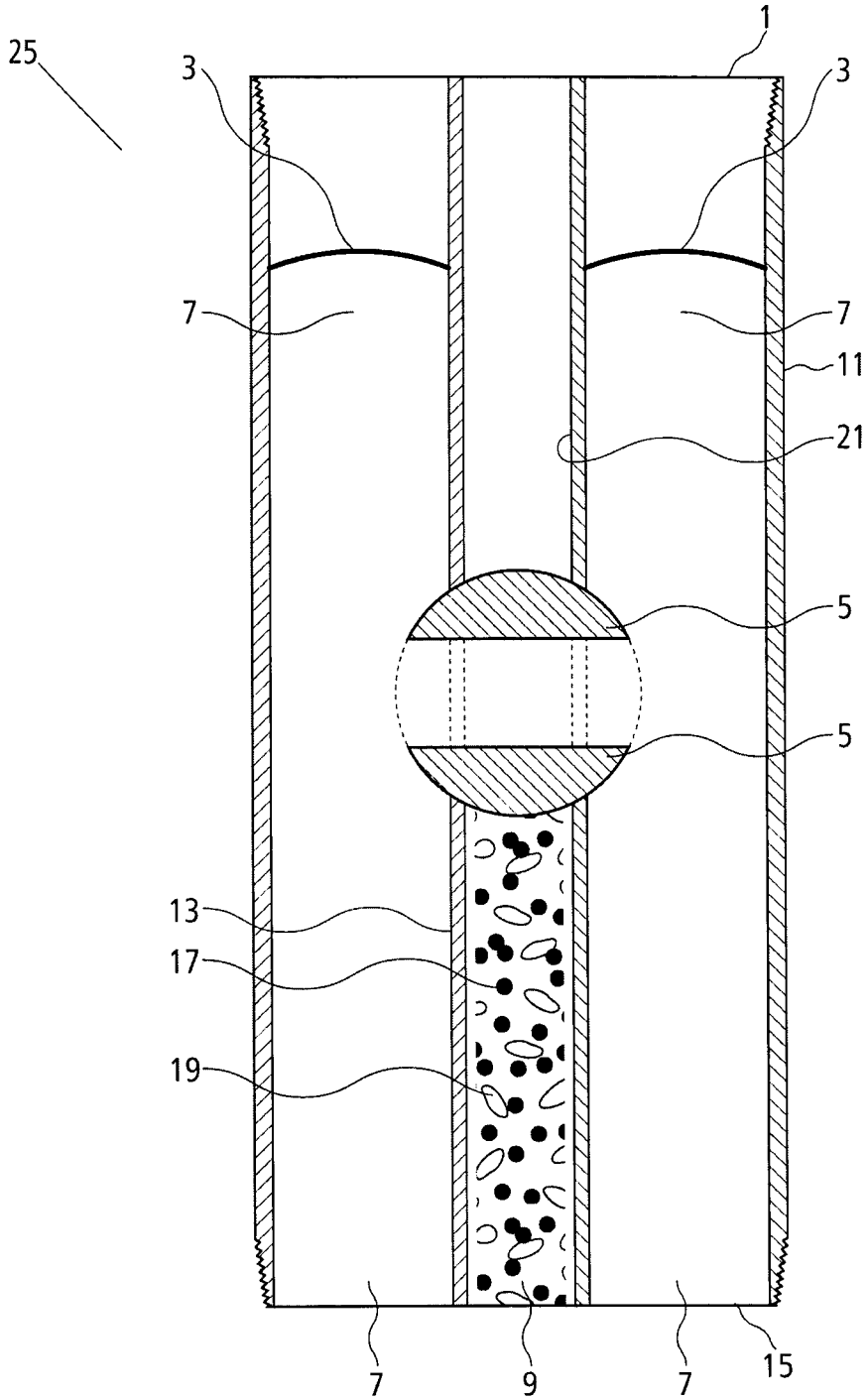
FIG. 2 is a vertical cross section of the downhole BOP of the present invention in the fully closed position.

FIG. 2 is a vertical cross section of downhole BOP 25 in the fully closed position. The downhole BOP will typically be in the fully closed position when adding additional concentric drill pipe to the existing concentric drill string. Check valve 3 is fully closed when there is no pressure being applied down annular passage 7 from pumping equipment at surface.

When ball valve 5 is in the closed position, exhausted drilling medium, drill cuttings, formation fluids and/or hydrocarbons 19 will not be able to travel past the fully closed ball valve 5 through inner passage 9.

Figure 3:
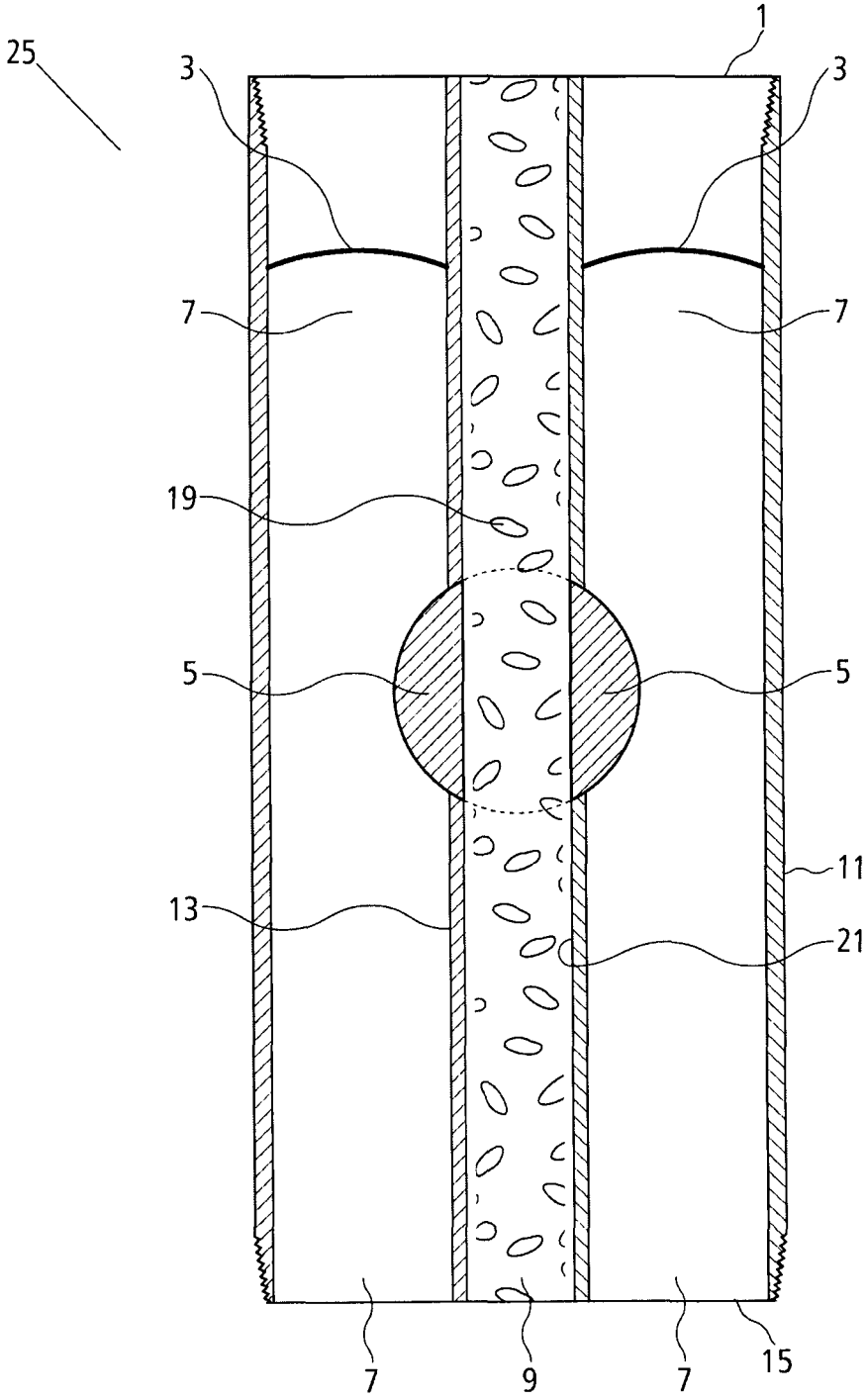
FIG. 3 is a vertical cross section of the downhole BOP of the present invention in the flow testing position.

As previously mentioned, the downhole BOP of the present invention can also be used during flow testing for hydrocarbons and the like during the reverse circulation drilling process. FIG. 3 is a cross section of downhole BOP 25 in the flow testing position. It is desirable to open hole flow test isolated areas of the wellbore for hydrocarbons at various stages during the drilling process. During testing, drilling is temporarily stopped and check valve 3 is fully closed as there is no pressure being applied down annular passage 7 from pumping equipment at surface. Ball valve 5 is kept in the open position to allow hydrocarbons to flow freely up inner passage 9 to surface.

In one embodiment of the present invention, the inner pipe or tube of the concentric drill pipe or concentric coiled tubing is preferably made from a pliable, conductive material such as rubber, rubber/steel, fiberglass or composite material, capable of withstanding the forces and pressures of the drilling operations. FIG. 4 is a cross section of concentric drill string 100 comprised of an outer drill pipe or coiled tubing 90 and an inner rubber tube 92. Wire 51 is wrapped around inner rubber tube 92 to provide an electric current to operate ball valve 5 of downhole BOP 25 by means of electric actuator 99.

In this embodiment, the inner tube 23 of downhole BOP 25 is made of steel and wire 51 is also wrapped around inner tube 23 to provide a continuous current. Wire 51 connects to electric actuator 99, which actuates the opening and closing of ball valve 5. Electric actuator preferably comprises an electric motor and gear drive that rotates the ball within the valve (not shown). Both the steel inner tube 23 and wire 51 are coated with fire resistant material. Wire 51 thus provides the electric current to electric actuator 99 to open and close ball valve 5. This allows the downhole BOP to be operated from the surface of the well if desired.

In a preferred embodiment of the present invention, ball valve 5 is always in the closed position until a power source is supplied to electric actuator 99 to open ball valve 5. Thus, if the power source fails due to a downhole fire or other problem, ball valve 5 will stay in the closed position while the concentric drill string is removed from the wellbore.

It is understood that downhole BOP 25 may be powered by a number of different methods including but not limited to electric current, capillary pressure, fiber optics, electro-magnetics, and radio frequency transmissions, all of which allow the downhole BOP to be operated from surface. As previously mentioned, ball valve 5 of down hole BOP 25 can also be put in the closed position manually when using concentric drill pipe, by turning the entire drill string slightly to the left. This allows the flow path of hydrocarbons, etc. through inner passage 9 to be closed off if all other operating methods fail.

It is further understood that the down hole BOP of the present invention can be used to drill vertically, directionally, or horizontally well bores in hydrocarbon and mineral exploration and development.

The foregoing disclosure and description of the invention are illustrative and explanatory thereof. Various changes in the size, shape and materials as well as the details of the illustrated construction may be made without departing from the spirit of the invention.

I claim:

1. A downhole flow control device for use during reverse circulation drilling with a concentric drill string, the concentric drill string comprising an inner pipe or tube having an inner passage therethrough and an outer pipe or tube surrounding the inner pipe or tube and forming an annular passage therebetween, the device adapted to be connected to the concentric drill string for well control, the device comprising:

(a) a first passage therethrough, the first passage being in fluid communication with the inner passage of the concentric drill string;

(b) a second passage therethrough, the second passage being in fluid communication with the annular passage of the concentric drill string;

(c) a full opening first valve assembly located in the first passage of the device adapted to be moved from a closed position to an open position, whereby, when the first valve assembly is in the open position, flow through the first passage of the device and the inner passage of the concentric drill string is substantially unrestricted; and (d) a second valve assembly located in the second passage of the device adapted to be moved from a closed position to an open position, whereby, when the second valve assembly is in the open position, material can flow through the second passage and the annular passage of the concentric drill string.

2. The downhole flow control device of claim 1 wherein the second valve assembly comprises a check valve.

3. The downhole flow control device of claim 2 wherein the check valve is moved from the closed position to the open position by exerting pressure on the valve by pumping air or fluid through the annular passage of the concentric drill string to the second passage of the device.

4. The downhole flow control device of claim 1 wherein the full opening first valve assembly comprises a full opening ball valve.

5. The downhole flow control device of claim 4 wherein the downhole flow control device further comprises an actuator operative to open and close the full opening ball valve.

6. The downhole flow control device of claim 5 wherein the actuator comprises a pneumatic actuator.

7. The downhole flow control device of claim 5 wherein the actuator comprises a hydraulic actuator.

8. The downhole flow control device of claim 5 wherein the actuator comprises an electric actuator.

9. The downhole flow control device of claim 1 wherein the downhole flow control device further comprises an actuator operative to open and close the full opening first valve assembly.

10. The downhole flow control device of claim 9 wherein the actuator comprises a pneumatic actuator.

11. The downhole flow control device of claim 9 wherein the actuator comprises a hydraulic actuator.

12. The downhole flow control device of claim 9 wherein the actuator comprises an electric actuator.

13. The downhole flow control device of claim 1 wherein the full opening first valve assembly is moved from the closed position to the open position by physically applying pressure to the concentric drill string and turning the concentric drill string either clockwise or counter-clockwise.

* * * * *